US010677432B2

(12) United States Patent
Chien

(10) Patent No.: US 10,677,432 B2
(45) Date of Patent: Jun. 9, 2020

(54) LED LIGHT HAS A BUILT-IN PROJECTION LIGHT AND NIGHT LIGHT AND/OR MULTIPLE FUNCTIONS

(71) Applicant: Tseng-Lu Chien, Walnut, CA (US)

(72) Inventor: Tseng-Lu Chien, Walnut, CA (US)

( * ) Notice: Subject to any disclaimer, the term of this patent is extended or adjusted under 35 U.S.C. 154(b) by 830 days.

(21) Appl. No.: 14/943,645

(22) Filed: Nov. 17, 2015

(65) Prior Publication Data

US 2016/0209013 A1 Jul. 21, 2016

Related U.S. Application Data

(60) Continuation-in-part of application No. 12/886,832, filed on Sep. 21, 2010, which is a division of (Continued)

(51) Int. Cl.

| | |
|---|---|
| ***F21V 21/30*** | (2006.01) |
| ***F21S 8/00*** | (2006.01) |
| ***F21V 29/00*** | (2015.01) |
| ***F21V 21/14*** | (2006.01) |
| ***F21S 10/00*** | (2006.01) |
| ***F21V 21/08*** | (2006.01) |
| ***F21S 9/02*** | (2006.01) |
| ***F21V 23/04*** | (2006.01) |
| ***F21V 14/02*** | (2006.01) |
| ***F21W 121/00*** | (2006.01) |
| ***F21V 21/29*** | (2006.01) |
| ***F21V 21/22*** | (2006.01) |

(Continued)

(52) U.S. Cl.

CPC ..... *F21V 21/30* (2013.01); *F21S 8/035* (2013.01); *F21S 8/038* (2013.01); *F21S 9/022* (2013.01); *F21S 10/002* (2013.01); *F21V 14/02* (2013.01); *F21V 21/08* (2013.01); *F21V 21/14* (2013.01); *F21V 23/04* (2013.01); *F21V 29/00* (2013.01); *F21V 9/08* (2013.01); *F21V 21/22* (2013.01); *F21V 21/29* (2013.01); *F21V 23/0492* (2013.01); *F21W 2121/00* (2013.01); *F21Y 2115/10* (2016.08); *Y10S 362/80* (2013.01)

(58) Field of Classification Search

CPC ..... F21V 29/004; F21V 29/407; F21V 15/01; F21V 31/00; F21V 14/02; F21V 21/14; F21V 21/22; F21V 21/29; F21V 21/30; G03B 21/20; G03B 21/2033; F21S 8/035; F21S 9/022; F21W 2121/00; F21W 2121/008; F21Y 2115/10; Y10S 362/806

USPC ..... 362/641, 642

See application file for complete search history.

(56) References Cited

U.S. PATENT DOCUMENTS 5,517,264 A * 5/1996 Sutton ..... F21S 8/035 353/119

5,926,440 A * 7/1999 Chien ..... F21S 8/035 362/253

(Continued)

*Primary Examiner* — Peggy A Neils

(74) *Attorney, Agent, or Firm* — Bacon & Thomas, PLLC

(57) ABSTRACT

An LED light has a built-in projection light and a night light to offer at least two functions for people in a dark environment. The projection light can project an image from any type of display-unit irrespective of geometric shape or image source or type, including display of digital data, wireless digital data, an LCD or TFT screen display, or any other display, enabling images of enlarged size to be projected onto a preferred surface, making it easier for people to see the image. The built-in night light helps people see things in a dark environment.

20 Claims, 6 Drawing Sheets

Related U.S. Application Data application No. 12/292,153, filed on Nov. 12, 2008, now Pat. No. 7,871,192, application No. 14/943,645, which is a continuation-in-part of application No. 14/539,267, filed on Nov. 12, 2014, which is a division of application No. 12/914,584, filed on Oct. 28, 2010, now Pat. No. 8,721,160, and a division of application No. 12/318,470, filed on Dec. 30, 2008, now abandoned.

(51) Int. Cl.
*F21V 9/08* (2018.01)
*F21Y 115/10* (2016.01)

(56) References Cited

U.S. PATENT DOCUMENTS 6,106,134 A * 8/2000 Bomas ..... F21S 8/083 362/153
6,140,934 A * 10/2000 Lam ..... B60Q 1/50 340/425.5
6,199,999 B1 * 3/2001 Cotton, Jr. ..... A47C 7/725 297/217.6
6,719,433 B1 * 4/2004 Belliveau ..... H04N 13/363 353/122
6,894,434 B1 * 5/2005 Kosoff ..... A61M 21/02 315/134
7,264,377 B2 * 9/2007 Cooper ..... F21V 23/0442 340/573.1
7,303,327 B2 * 12/2007 Copeland ..... F21S 8/035 362/271
7,390,092 B2 * 6/2008 Belliveau ..... H05B 37/0254 345/156
7,677,770 B2 * 3/2010 Mazzochette ..... F21S 8/026 362/294
7,832,917 B2 * 11/2010 Chien ..... F21S 8/035 362/641
8,089,691 B2 * 1/2012 Arbuckle ..... G02B 21/16 359/363
8,328,368 B2 * 12/2012 Luciano ..... G03B 21/10 353/79
8,657,464 B2 * 2/2014 Lundberg ..... F21V 14/04 362/232
2002/0093296 A1 * 7/2002 Belliveau ..... H05B 37/0254 315/294
2003/0117090 A1 * 6/2003 Belliveau ..... F21V 29/67 315/368.28
2012/0257418 A1 * 10/2012 Fields ..... F21S 8/035 362/641

* cited by examiner

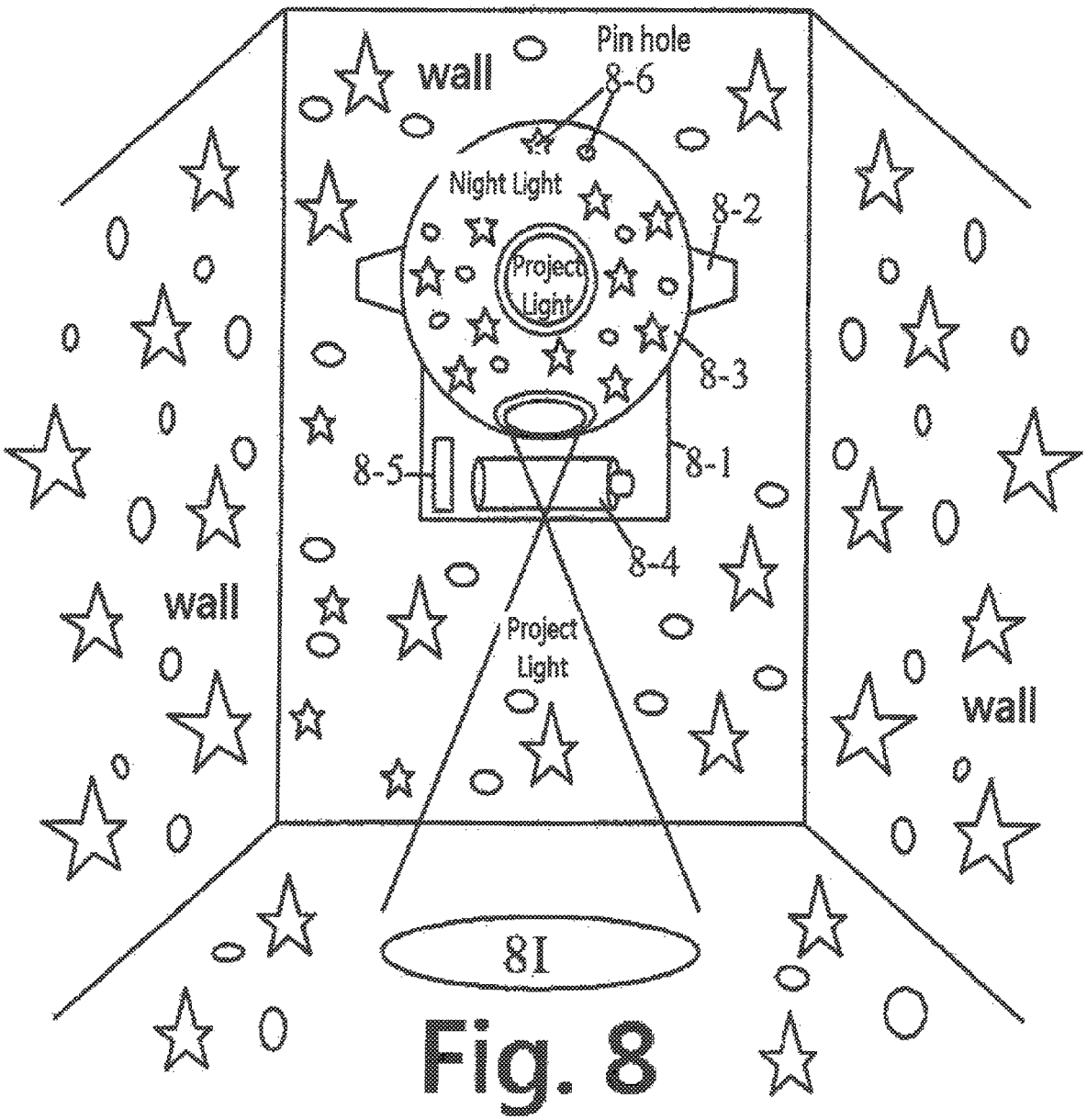
Fig. 8
Fig. 9
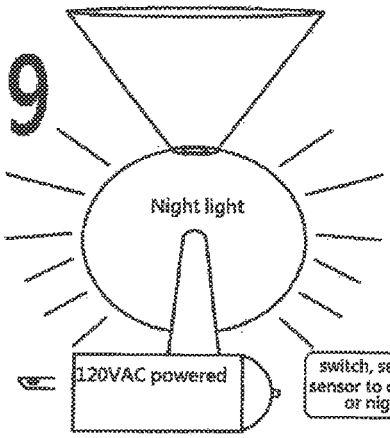
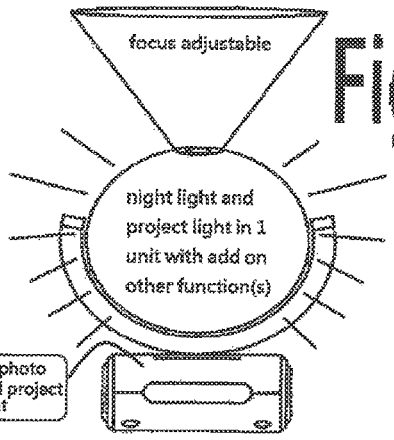
Fig. 10

LED LIGHT HAS A BUILT-IN PROJECTION LIGHT AND NIGHT LIGHT AND/OR MULTIPLE FUNCTIONS

This application is a continuation-in-part of U.S. patent application Ser. No. 12/886,832, filed Sep. 21, 2010, which is a divisional of U.S. patent application Ser. No. 12/292,153, filed Nov. 12, 2008, and incorporated herein by reference.

This application is a continuation-in-part of U.S. patent application Ser. No. 14/539,267, which is a divisional of U.S. patent application Ser. No. 12/914,584, now U.S. Pat. No. 8,721,160, which is a divisional of U.S. patent application Ser. No. 12/318,470, filed Dec. 30, 2008, abandoned, each of which is incorporated herein by reference.

BACKGROUND OF THE INVENTION

This application has subject matter in common with the inventor's U.S. patent application Ser. Nos. 12/624,621, 12/622,100, 12/318,471, 12/318,470, 12/318,473, 12/292,153, 12/232,505, 12/232,035, 12/149,963, 12/149,964, 12/073,095, 12/073,889, 12/007,076, 12/003,691, 12/003,809, 11/806,711, 11/806,285, 11/806,284, 11/566,322, 11/527,628, 11/527,629, 11/498,874, 12/545,992, 12/806,711, 12/806,285, 12/806,284, 12/566,322, 12/527,628, 12/527,629, 12/527,631, 12/502,661, 11/498,881, 11/255,981, 11/184,771, 11/152,063, 11/094,215, 11/092,742, 11/092,741, 11/094,156. 11/094,155. 10/954,189, 10/902,123, 10/883,719, 10/883,747, 10/341,519, 12/545,992, 12/292,580, 12/710,918, 12/622,000, 12/710,561, 12/710,12/711,456, and 12/771,003.

The above-listed earlier filed cases apply optic theory to LED lights for outdoor or indoor application, and that are powered by alternating current (AC) or direct current (DC) supplied by and electric cord and plug for an outlet, a battery, a transformer, a solar power source, or another power source to create a plurality of LED light beams to illuminate a close area(s) and a remote area(s), the remote area being illuminated by projection means which may further incorporate the inventor's previously-disclosed features, such as more than one light source, more than one function, more than one optics means, and more than one projection means, utilizing the inventor's additional power saving and cost saving concepts.

Current market-available night lights have no projection function. To make up for this lack of a projection night light, the present inventor filed a large number of prior patent applications. The night light of the current invention improves upon the inventor's prior night lights in that the night light of the present invention not only may be powered by an outlet power source via prong means, but it also can be used on a desk top or any other location where light illumination can be provided to people during the night for indoors or outdoors use, the invention being applicable to any light device in which a night light has a built-in projection light for any purpose.

While projection lights are known in the toy market, there is no prior projection light having a built-in night light because a night light needs a continuous power source. Furthermore, the majority of projection lights are powered by batteries and have incandescent bulb light sources, which cannot be left continuously on because the batteries will last less than several hours. However, using newly available LEDs for power saving, one can get tens of hours if incorporated with the inventor's power saving circuit (described in U.S. patent application Ser. No. 12/711,456 and other patent applications of the inventor), so that the batteries will last more longer. The LED night lights having projection means described in the inventor's allowed U.S. patent application Ser. Nos. 12/232,505, 12/292,153, 12/318,473 differ from the conventional single projection lights for toys, hand-held projection lights, or desk top projection lights in that the conventional single projection lights lack the following features:

(a) a continuous switch position to keep the night light on all the time;
(b) housing parts designed to project light to and sit on a surface;
(c) a built-in night light—the majority of desk top projection lights not only lack a continuous turn-on night light switch, but even do not have a steady-on select switch;
(d) a power saving circuit selection—because earlier items were powered by a bulb which has super big power consumption, they have no night light function;
(e) a focus mechanism for obtaining a clear image during long distance projection—the majority provide only provide a clear image over a short distance from the projection head to the projection surface, which is not longer than people's one arms total length, with toys generally being designed for projection to a desk surface or near a wall so that larger, more distant images will not be clear at all;
(f) adjustable focus features for long distance projection beyond a human arm length; and
(g) a swivel, spin, or rotate projection head design to allow an image to change position at any time and stay there while putting the projection light on a surface—because hand-carried items do not need to spin, but rather can change projection direction just by moving one's hand, such items do not need a swivel, spin, or rotate mechanism.

In contrast, features of preferred embodiments of an LED light with built-in projection light and night light include:

(1) The LED light with built-in projection light and night light can be connected to either an outlet power source or battery (energy storage means) to project an image, time, weather, message, display, digital data, cartoon characters, advertisement, seasonal data, promotion art, or other any other signals to people, so that the desired night light can have all kinds of light sources available from the marketplace, which is a very good combination;
(2) The LED light with built-in projection light and night light may incorporate a desired combination of switch means, conductive means, sensor means, remote control means, wireless means, digital data means, transmission means, photo sensor means, manual switch means, automatic means, motor means, gear set means, swivel means, rotating means, spin means, USB means, digital data storage means to have a proper function to cause the projection light to have desired functions, effects, or performance;
(3) The projection light and night light of the LED light can be turned on and off according to a predetermined timing, to provide desired light functions and performance selected from the marketplace.
(4) The projection light can have extra features including (4a) focus adjustment, (4b) changeable projection head position or orientation to project the image anywhere as desired, (4c) a projection head that can swivel, rotate, or spin, (4d) a proper housing design to allow the unit to be installed on any surface without movement, (4e) motor means to cause an image to be continuously changing, (4f) gear set means to cause the image to rotate at a desired speed, (4g) the image can be projected to appear a long distance away from the projection head, (4h) the LED light can be in the form of a desk top light with a base having a built-in night light with a switch to turn it on and for an extended period of time.

(5) The projection light may have a focus designed for a long distance which at least longer than arm's length.

(6) The projection light may project a focused image over a distance of three feet or more.

BRIEF DESCRIPTION OF THE DRAWINGS

FIGS. 6, 7, 8, 9, and 10 are different views of the built-in projection light and night light shown FIGS. 1-5, taken from different viewing angles. Also from FIG. 6 show the plurality of pin-hole by silkscreen or openings to make the twinkle stars or image project by pin-hole theory which show one of the plurality of added functions.

DETAILED DESCRIPTION OF THE PREFERRED EMBODIMENTS

Figure 1:
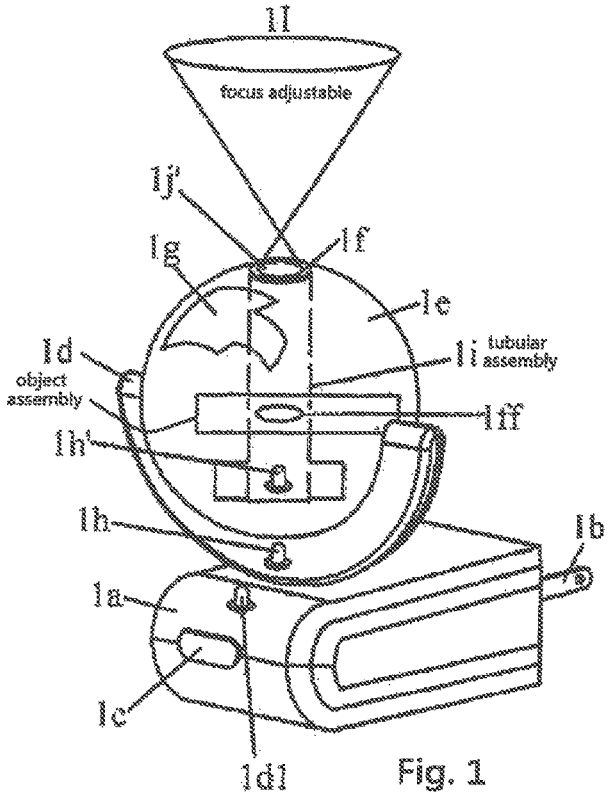
FIG. 1 shows a first preferred embodiment which has a built-in projection light and night light including a projection means, more than one light means, and swivel, rotate, or spin means to change the projection means' direction or orientation. The projection light may incorporate switch means, sensor means, or other means to cause the projection light or night light to turn on and turn off as required. The power source of this embodiment is an outlet power source connected by prong means.

FIGS. 1 and 1-*a* show a first preferred embodiment of an LED light having a built-in projection light (1*f*) and night light (1*h*). As shown in FIG. 1-*a*, the at least one LED projection light has desired parts and accessories including (A) a tubular assembly (1*i*), telescoping or extendable-retractable housing-parts or tray or holder or supporter or arms or unit assembled together to prevent LED light beam leakage out while traveling from the LED location to an image-forming-piece top projection-lens (not shown), (B) at least one LED for supply sufficient LED light beam for project light source.

(C) optics lens for magnify or refract and enlarge (1-*j*), (D) at least one of an image-forming unit or a display-unit assembly (1*f*) has desired assortment or combination select from (a) tray or holder or housing-parts (1-*g*), (*b*) film (not shown), (c) LCD display (1*f*), (*d*) TFT display (1*f*), (*e*) digital data display (1-*f*), (*f*) wireless digital display means (1*f*), (*g*) time piece display means (1*f*), (*h*) weather displayer means (1*f*), and/or (E) At least one of preferred parts or accessories for installation LED light select from (i) housing-parts or tube-assembly (1-*a*) (1-*a*') (1*b*) (1-*b*') (1-*i*) (1-I') (1-I") (1-2 (1-2'), (ii) screen or more displayer (1*f*), (iii) light block out piece or stencil for pattern projection (1*d*), (iii) fixing or assembling or snap-tight or press-tight kit(s) or construction to assemble tube-assembly or housing-parts, trays, holder, tubular-piece together (1-*d*1), (iv) transparent or light-passing piece or open areas or display-unit segments and the like, (v) translucent piece which for base or frame or compartment-cover where not want to see through or not want light emit out, (vi) opening, cut-out (1-*i*''') (1-*i*'''), (vii) $2^{nd}$ or more LED for night light or other functions but not for project image single LED (1*d*1 of FIG. 1), (viii) project light LED (1-*c*), (ix) a lens assembly (1*f* and 1*ff* of FIG. 1), (xi) attachment or press-tight or snap-tight or screw-and-hole or hole-and-pole set (1-*n*) (1-*p*) (1-*n*') (1-*p*'), (xii) supporter or holder or tray or bar or tubular-piece or housing-part(s) (1-*d*2) (1g) (1*d*1) (1-*b*) (1-*d*) (1-1') (1-I") (1-*i*), upper housing-part (2 semi-ball), lower housing-part, or base of (1*a* of FIG. 1), frame parts (1*d* of FIG. 1), or (xiii) other parts and accessories (not shown)

The three major parts of project-assembly including (B) LED (C) Optics-lens (D) image-forming-units are assembled to project an image, time, weather, message, display, digital data, cartoon characters, advertisement, seasonal data, promotion art, light beams only, or any geometric art, drawing, photos, negative, positive film, LCD screen image, TFT screen image, display-unit image, or any other signals or message that can be recognized and seen by people. The said lighted image (1I) or pattern (1I) or art or time/weather (1I) or digital data image (1I) project to top ceiling (see 6I of FIG. 6), to far-away distance wall (see 6I2 of FIG. 6), house (6I2), building (6I2), fence (6I2), garage door (6I2) for indoor or outdoor applications and the lighted image or patterns or arts or all can be adjust angle while rotate the housing part (1*e*), or upper project-ball (1*e*) and/or rotate the Y-frame (1*d*) so can adjust lighted image or pattern to any position of x-y-z axis cover range. While the LED light is powered by DC power source (8-4 of FIG. 8) or batteries (8-4 of FIG. 8) or rechargeable battery (8-4 of FIG. 8) can install on higher-location with (i) motion-sensor to trigger or (ii) remote controller to trigger for project the desired lighted patterns or-and image (8 I of FIG. 8) by project-assembly (2 coin-center circles) and also can have the built-in pin-hole image light effects made by the upper housing-part shaped pin-hole(s) (8-3) (8-6) by inner $2^{nd}$ or more LEDs for $2^{nd}$ or more functions (Pin-hole image) surrounding the LED light. Same as the FIG. 7 with projected lighted image or-and patterns (6I) (6I2) as above discussed but also the upper housing-part (6-3) is a ball shape with plurality of shaped pin-holes with art or shaped (6-4) for AC-powered LED light which has conductive-piece including built-in prong or AC-plug-wire to connect with AC outlets to get AC current go through built-in AC-to-DC circuitry to suppler project LED (not shown) and pin-hole image LED(s) for pin-hole image light effects surrounding all surface of the said LED light locations. The Said LED light has motion sensor (6-9) or wireless receiverkits (6-5) to receive the wireless or RF or Z-wave or Zigbee wireless transmitter signal to activate the LED light for desired functions.

Figure 1A:
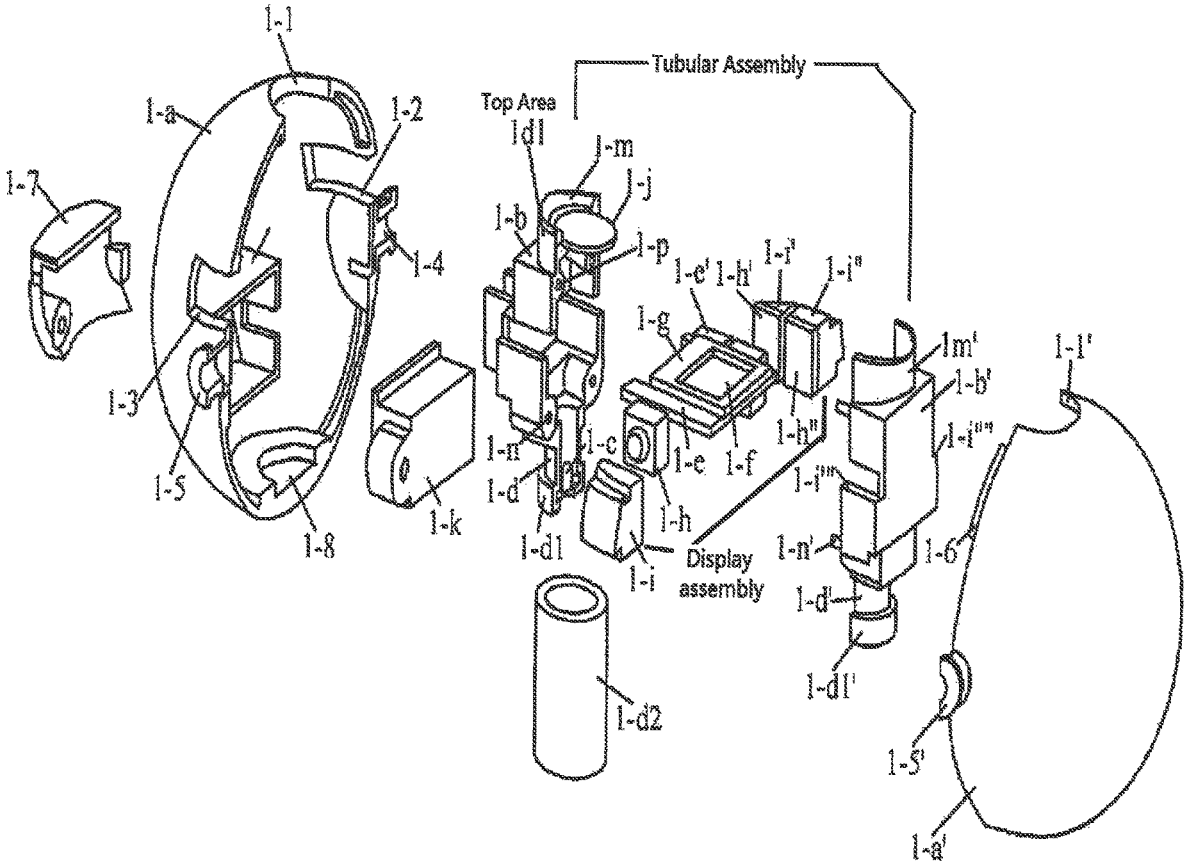
Figure 4:
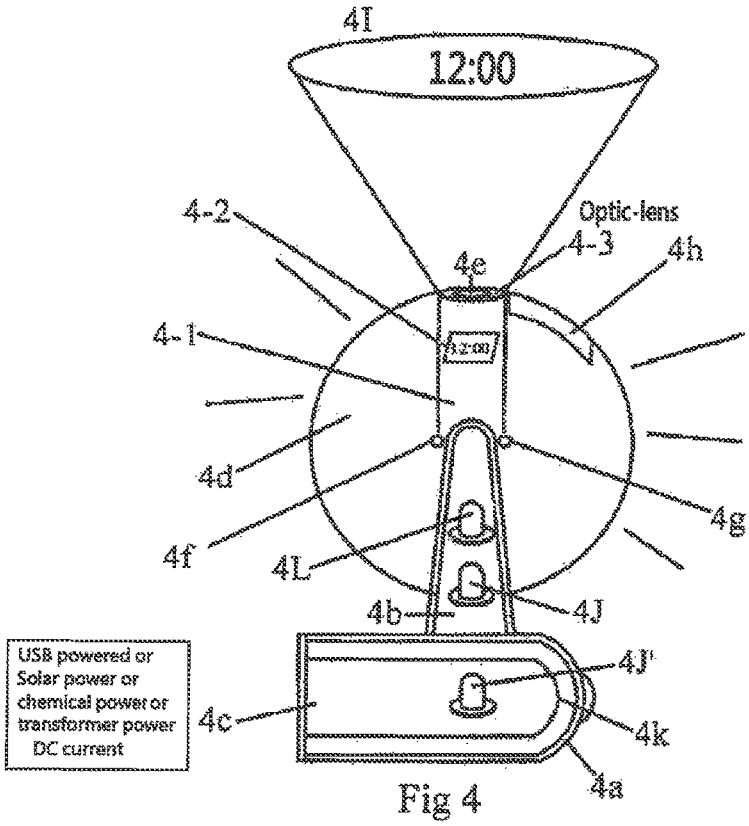
Figure 5:
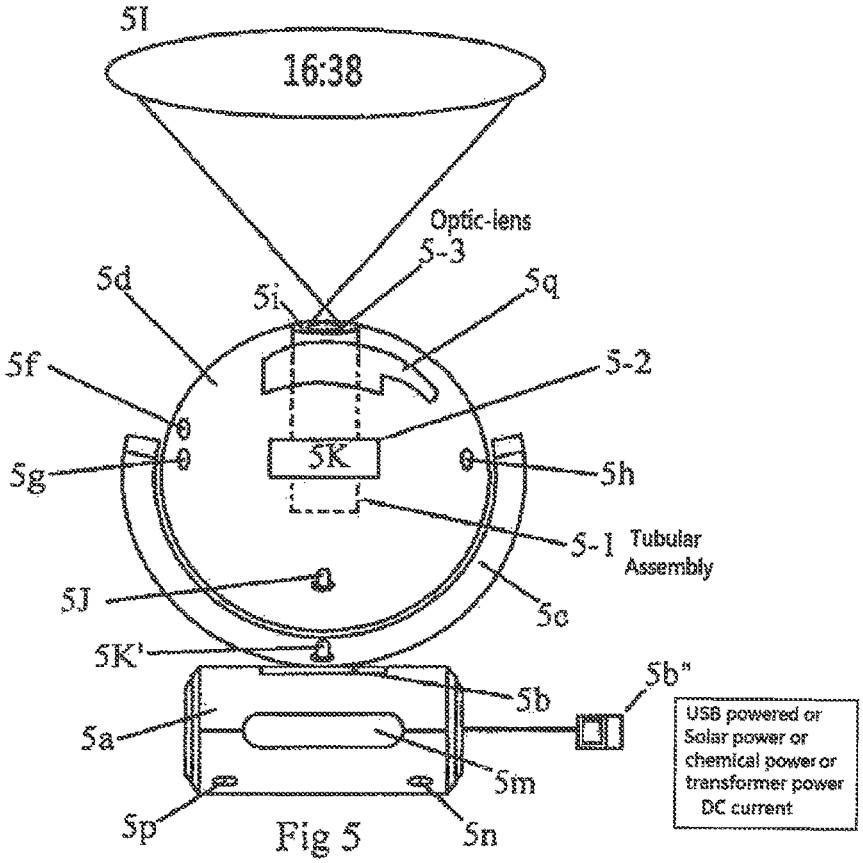

As shown in FIG. 1, the LED light may have more than one LED light source (1*h*) (1*h*'), swivel, extending poles, or rotating Y-frame (1*d*), rotate construction (not shown), or spin construction (not shown) to change the projection image present location, direction or orientation. The LED projection light may incorporate switch (1*c*), sensor (1*c*), or other remote or wireless controller (not shown) to cause the projection light or night light to turn-on and turn off as required. The power source for this embodiment is an outlet power source connected by conductive-piece with or without wire including prong or AC-Plug wire (1*b*). From FIG. 1 show the LED project light has the upper housing-parts (1*e*) and Lower housing parts (1*a*) with desired Y-frame (1*d*) to assembled together and the said Y-frame (1*d*) has base which assembled with lower housing-part (1*a*) so can rotating on horizon-axis for 360 degree and the upper housing-parts is a ball which has two-ear [(1-4) and (1-5) of FIG. 1*a*] to assemble with Y-frame (1*d*) so can make the vertical rotating for 360 degree.

Figure 2:
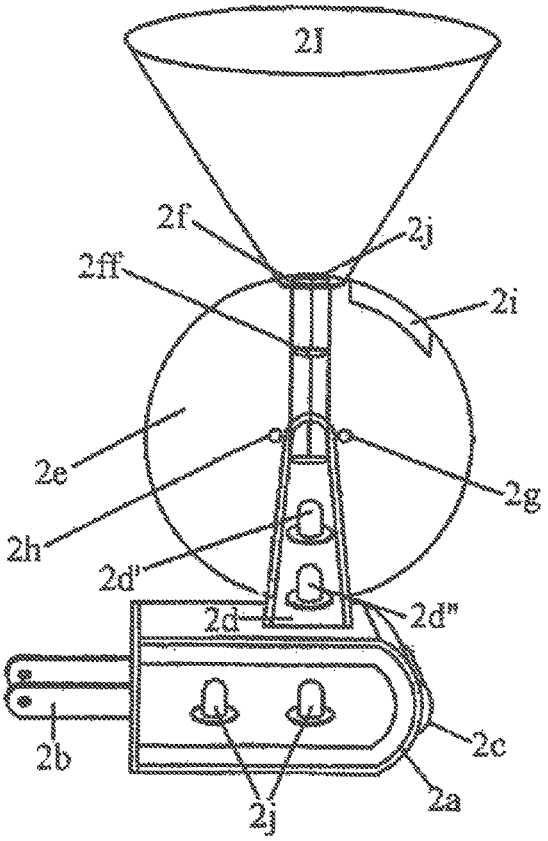
FIGS. 1*a*, 2, 3, 4, and 5 show the detailed construction of the first preferred embodiment including a front housing, back housing, more than one LED, sensor means, a battery cover, batteries, time adjustable switches, manual switches, photo sensor means, inner circuit means, LCD display means, digital data display means, and swivel, rotate, or spin means to allow the projection head to change position, base spin, swivel, or rotate means (the housing has movable features), a retractable or foldable prong means, housing means for the prong means or energy storage means, and/or time-related parts and accessories arranged in one area so as to simplify electric signal delivery.
Figure 3:
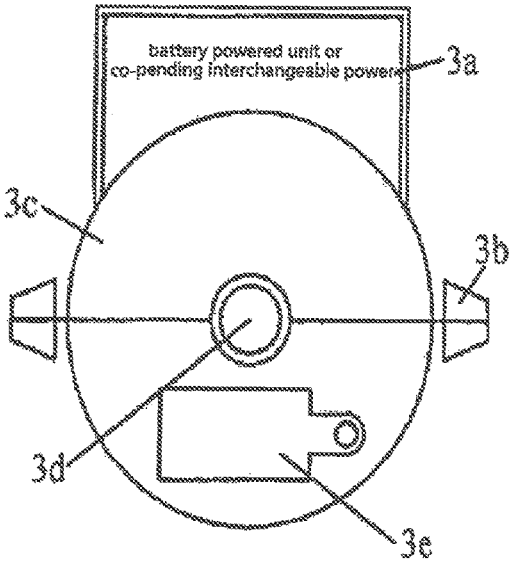

FIGS. 2, 3, 4, and 5 show the detailed construction of the first preferred embodiment. As shown in FIG. 2, a time display projection light has a built-in project light (2*d*') and night light (2*d*"). The projection light is part of a projection assembly (2*f*) including a housing (2*e*) and more than one LED (2*d*') (2*d*") (2*j*), retractable or foldable prong means (2*b*), sensor means (2*c*), a battery cover (not shown), batteries, time adjustable and setting switch(s) (2*g*) (2*h*), manual switch(s) (2*c*), photo sensor means (2*c*), inner circuit means (not shown), LCD display means (see FIG. 1*a*), a digital data display means (FIG. 1*a*), swivel, rotate, or spin means to allow the projection head to change position, base spin, swivel or rotate means provided by the housing having movable features such as a Y-frame or ball that can rotate or spin), housing means for installing the prong means or energy storage means such as batteries, switch means arranged on a desired location on a ball or base, and/or time related parts and accessories (such as those shown in FIG. 1*a*) arranged in one area rather than more than one area. These FIGS. 2, 3, 4, and 5 all show a preferred construction for a time projection light having built-in time related parts and accessories.

Figure 6:
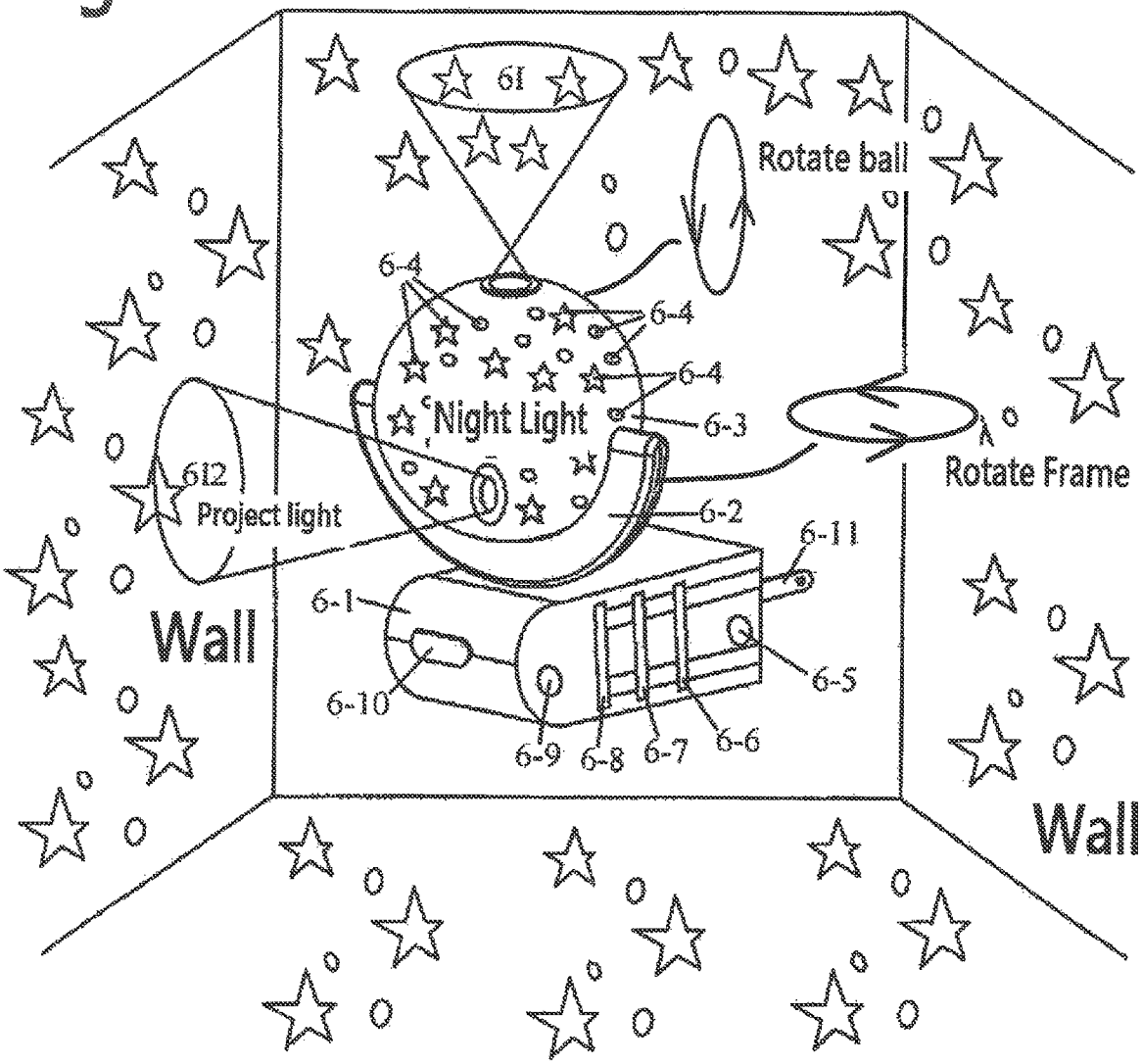
Figure 7:
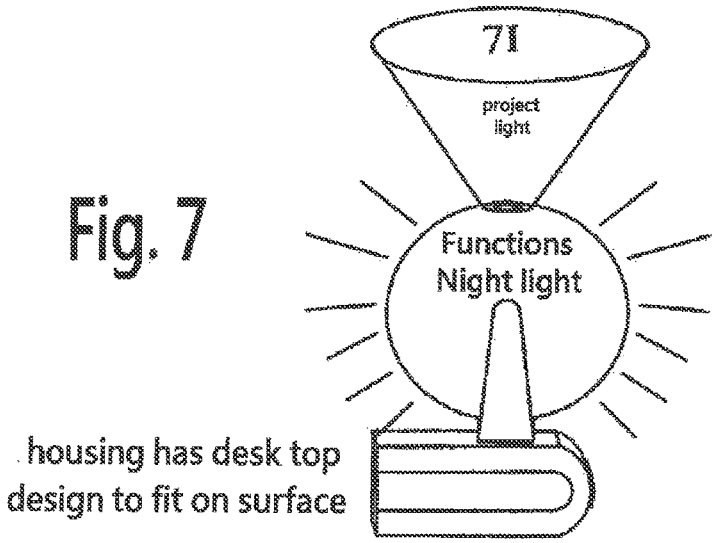

FIGS. 6, 7, 8, 9, and 10 all show the embodiment of FIGS. 1, 1*a*, 2, 3, 4, and 5 taken from different viewing angles. Also from FIG. 6 show the plurality of pin-hole by silkscreen or openings to make the twinkle stars or image project by pin-hole theory which show one of the plurality of added functions including the functions wireless, motion sensor, blue-tooth communication, power failure, Charging by USB assembly, or other preferred or desired functions as the drawing show on the base.

Figure 11:
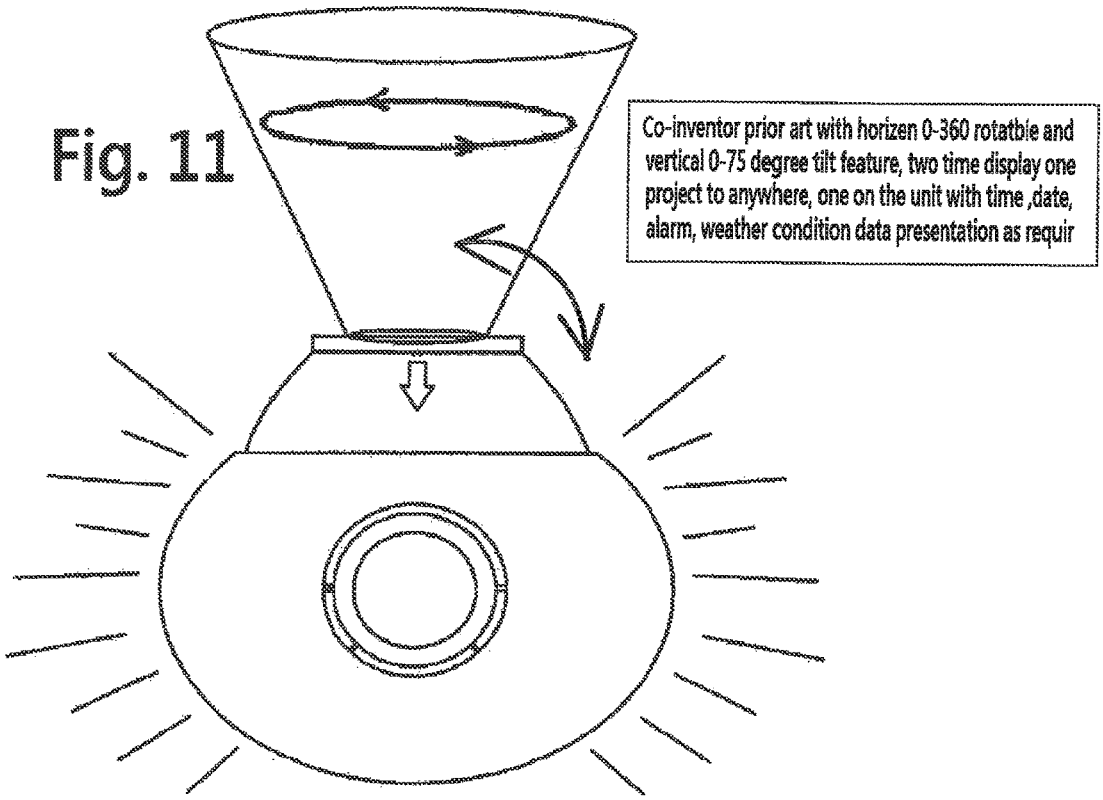
FIGS. 11 and 12 show variations of the preferred embodiment of FIGS. 1-10, with different shapes for horizontal 0-360 degree rotation and vertical 0-360 degree rotation to enable an image to be projected anywhere.
Figure 12:
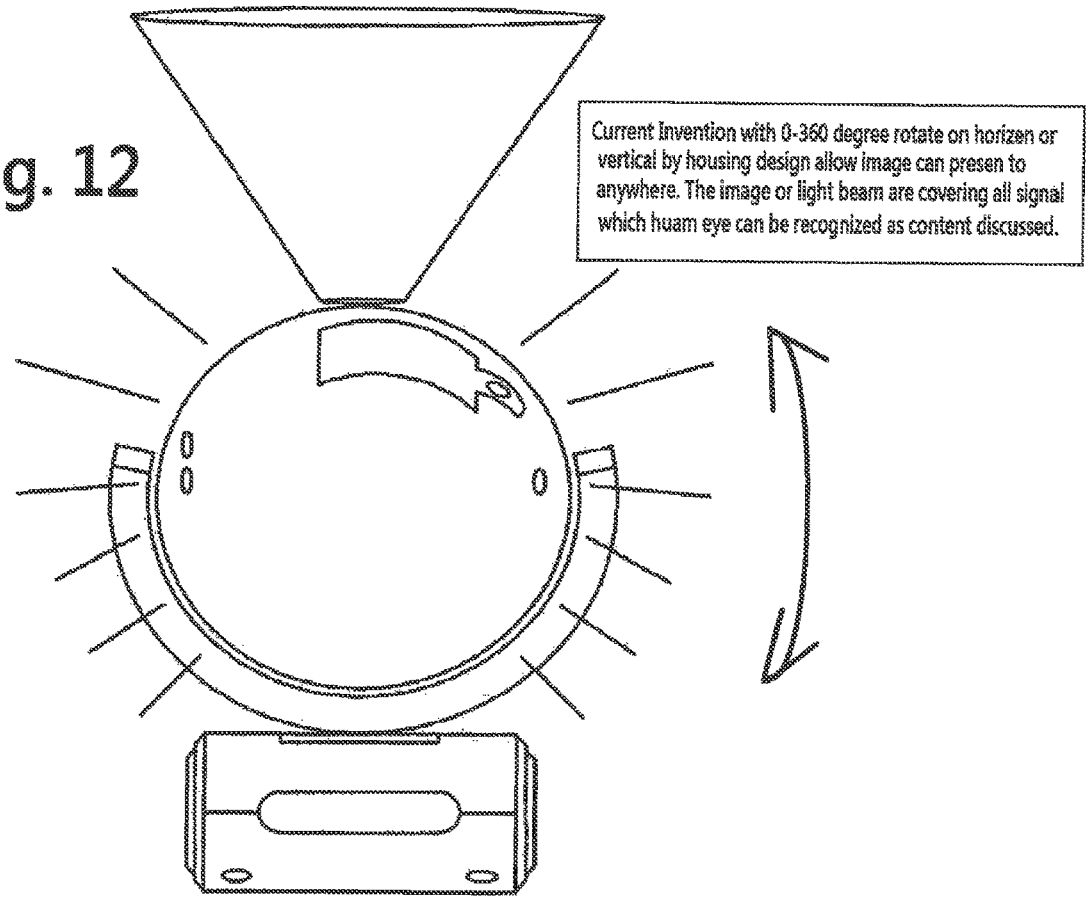

FIGS. 11 and 12 show the preferred embodiments of FIGS. 1 to 10 with different shapes corresponding to those disclosed in copending U.S. patent application Ser. No. 12/624,621 (see FIG. 16-1) and Ser. No. 12/886,832 (See FIG. 5 and FIG. 5-1). Unlike the projection lights disclosed in the copending applications, the projection light of the preferred embodiment is capable of horizontal 0 to 360 degree rotation and vertical 0-360 degree rotation to enable an image to be projected to anywhere. The projection lights of the copending applications have horizontal 0 to 360 degree rotation but vertical rotation has limited angles whereas the Y-Frame can be rotated 0 to 360 degrees and the ball itself can rotate from 0 to 360 degree relative to the Y-frame).

The current invention has both a projection light and a night light, thereby providing at least two functions for the LED light, which is unique. It should also be appreciated that any alternative, revision, amendment, or improvement will fall within the scope of the invention as long as it provides similar or equivalent functions, performance, effects, and results.

I claim:

1. An LED projection light, comprising:

at least one LED;

an image forming unit;

a magnifying projection lens or lens assembly;

a housing assembly including at least one inner tube, at least one tray, at least one holder, or at least one compartment for preventing leakage of light emitted from the LED through the image forming unit to the magnifying projection lens;

at least one movable housing part that is configured to replace or to swivel, spin, rotate, or move to change a location of at least one projected image or pattern or adjust a focus of the at least one projected image or pattern, wherein the magnifying projection lens or lens assembly is installed (i) on a top area of the housing, (ii) above the at least one inner tube, or (iii) within the at least one tray, at least one holder, or at least one compartment, to magnify and project the image or pattern onto an indoor or outdoor surface that is at least an arm's length away from the LED projection light, wherein the image forming unit includes at least one of the following elements situated between the LED and the magnifying projection lens or lens assembly:

(a) a fixed image forming element including a fixed position display unit or film;

(b) a changeable or movable image forming element including a timepiece screen, an LCD display, a TFT display, an Lcos display, a moving or rolling disc in which a plurality of projection lenses are installed, a moving or rolling printed or painted piece, or a digital data display;

(c) a wireless transmitting and receiving changeable digital data element, including a wireless digital data display, a weather display, or a wireless display screen; and (d) a film, slide, transparent image forming element, or plurality of films, slides, or lenses transparent image forming elements installed on a disc or holder, wherein the LED light projects at least one of the following lighted images or patterns: time, weather information, messages, digital data, cartoon characters, advertisements, seasonal data, promotional art, graphics, and light beam patterns, and wherein the LED projection light includes circuitry for turning the at least one LED on and off to achieve predetermined functions, effects or performance in response to a switch, sensor, manual control or wireless control, wherein the LED projection light is powered by at least one of:

(A) an alternating current (AC) input through a built-in or external AC-to-DC circuit for converting the input AC into a working current for the at least one LED and circuitry;

(B) a direct current (DC) from a battery, USB wired power source, USB backup power source, rechargeable battery of a solar power source, rechargeable battery of a wind power source, generator power source, built-in AC-to-DC circuit, or external transformer having a DC power output; and (C) an adaptor having a DC power output and a DC power storage element.

2. The LED projection light of claim 1, wherein the housing assembly includes at least one of an upper housing part and a frame or base, arranged to swivel, rotate, or spin and thereby change a position, orientation, or direction of the projected image or pattern.

3. The LED projection light of claim 1, wherein a focus of the projection light is adjustable by moving the magnifying projection lens to change a relative position of the magnifying projection lens and the image forming unit.

4. The LED projection light of claim 1, wherein the LED projection light includes multiple projection assemblies or heads aimed in different directions, and wherein the housing assembly is arranged to swivel, rotate, or spin.

5. The LED projection light of claim 1, wherein the LED projection light projects a moving or changeable image or light beams to a distant surface.

6. The LED projection light of claim 1, wherein said at least one movable housing part is movable about one or more axes in three dimensions.

7. The LED projection light of claim 1, wherein the LED projection light further includes at least one second LED arranged to illuminate close areas or parts of the LED projection light while the at least one first LED serves as a LED projection light source to project said image or pattern to distant areas.

8. The LED projection light of claim 1, wherein the LED projection light includes at least one of an IC, timer, and time delay to achieve predetermined light performance effects.

9. An LED projection light, comprising:

at least one first LED;

an image forming element including at least one of a film, slide, transparent image forming element, display unit, and digital data display;

at least one projection lens or lens assembly;

at least one tubular piece or tubular housing part, tray, holder, or compartment for preventing leakage of light emitted from the at least one first LED through the image forming element to the projection lens or lens assembly, wherein the at least one LED is installed on a first side of the at least one tubular piece or tubular housing part, tray, holder, or compartment, and at least one projection assembly including the projection lens or lens assembly is installed on a second side of the at least one tubular piece or tubular housing part, tray, holder, or compartment, to magnify and project an image or pattern onto an indoor or outdoor surface that is at least an arm's length away from the LED projection light; and wherein said at least one projection assembly is arranged to project at least one of the following lighted images or patterns: time, weather information, messages, digital data, cartoon characters, advertisements, seasonal data, promotional art, graphics, and light beam patterns, and wherein the at least one LED is arranged to be turned on and off to achieve predetermined functions, effects or performance in response to a switch, sensor, manual control or wireless control, wherein the LED light is powered by an alternating current (AC) input through a built-in or external AC-to-DC circuit for converting the input AC into a working current for the at least one LED and circuitry.

10. The LED projection light of claim 9, further comprising a built-in night light or time display device having at least one second LED.

11. The LED projection light of claim 9, further including a second projection-assembly with its own project LED light-source for projecting a second lighted image or patterns to a surface at least one arm's length away from the LED projection light.

12. The LED projection light of claim 9, further comprising at least one second LED light source to provide the following additional light functions:

a. a power failure light or emergency light function powered by backup batteries;

b. a motion sensor light function which turns on the at least one first LED and/or the at least one second LED when a person is within a predetermined distance of the LED projection light;

c. a remote control or wireless control light which turns on or off in response to signals from an infrared transmitter, a Bluetooth transmitter, an RF transmitter, a Wi Fi router transmitter, or a wireless controller.

13. The LED light of claim 9, wherein the LED light is arranged to be installed on a desktop, wall, ceiling, floor, or outlet, or outdoors.

14. The LED light of claim 9, wherein lighting functions of the LED projection light, including near-by illumination, remote-distance illumination, or image projection, are controlled by a manual or auto switch, sensor, or a wireless controller.

15. The LED light of claim 9, the LED projection light includes at least one additional built-in lighting device powered by a separate power source and power circuitry.

16. The LED light of claim 15, wherein the at least one additional built-in lighting device is controlled by a separate controller.

17. The LED light of claim 9, the LED projection light includes at least one additional built-in time related device including at least one of an LCD time display with LED backlight, and LED time display device.

18. The LED light of claim 15, wherein the at least one additional built-in lighting device is one of an LCD time display device, LED time display device, or LED night light, the light device having at least one function selected from color changing, color selection, or function selection.

19. The LED light of claim 1, wherein the LED light is arranged to be installed at an outdoor location.

20. The LED light of claim 1, further comprising a second built-in LED, and wherein lighting functions of the LED light, including near-by illumination, remote-distance illumination, or image projection, are controlled by a manual or auto sensor, or a wireless controller.

* * * * *